US009418633B1

(12) United States Patent
Storck

(10) Patent No.: US 9,418,633 B1
(45) Date of Patent: Aug. 16, 2016

(54) PICK HOLDER FOR STRINGED MUSICAL INSTRUMENT PICKS

(71) Applicant: Kurt Storck, Farmington Hills, MI (US)

(72) Inventor: Kurt Storck, Farmington Hills, MI (US)

( * ) Notice: Subject to any disclaimer, the term of this patent is extended or adjusted under 35 U.S.C. 154(b) by 0 days.

(21) Appl. No.: 14/867,109

(22) Filed: Sep. 28, 2015

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS 1,557,476 A * 10/1925 Kimball et al. ..... G10D 3/163 84/322
2,726,757 A * 12/1955 Kellstrom ..... B60R 7/087 206/0.8
4,135,431 A * 1/1979 Ferguson ..... G10D 3/163 206/314
4,785,708 A * 11/1988 Vaughan ..... G10D 3/163 84/322
4,890,531 A * 1/1990 Tischer ..... G10D 3/163 84/322
D355,667 S * 2/1995 Burger ..... 84/329
5,651,468 A * 7/1997 Irizarry ..... A47F 7/0042 211/120
6,054,643 A * 4/2000 Chance ..... G10D 3/163 84/315
6,215,052 B1 * 4/2001 Giddens ..... G10D 3/163 211/120
7,417,184 B2 * 8/2008 Weathersby ..... G10D 3/163 84/322
7,847,171 B1 * 12/2010 Kidd, III ..... G10D 3/163 84/329
8,097,799 B2 * 1/2012 Tran ..... G10D 3/163 84/322
D697,707 S * 1/2014 Surabian ..... D3/204
8,716,581 B1 * 5/2014 Boyd ..... G10D 3/163 84/329
D707,287 S * 6/2014 Thomas ..... D17/20
8,742,239 B1 * 6/2014 Storck ..... G10D 3/163 84/320
D711,963 S * 8/2014 Gilmore ..... D17/20

* cited by examiner

*Primary Examiner* — Robert W Horn
(74) *Attorney, Agent, or Firm* — Thomas P. Heed

(57) ABSTRACT

The present invention is a pick holder for a musical instrument. The pick holder has a plurality of retention clips on its face, in which can be placed musical instrument picks. The material of the face of the flexible container and pick holder is such that the musician's thumb can easily swipe or move a guitar pick across it. The present invention can be positioned so that the musician can easily reach the face containing the picks using the thumb of the strumming hand.

15 Claims, 8 Drawing Sheets

PICK HOLDER FOR STRINGED MUSICAL INSTRUMENT PICKS

FIELD OF INVENTION

This invention relates to the field of musical instruments, specifically to article holders which attach to musical instruments and hold items such as picks.

BACKGROUND OF INVENTION

The inventor of the present invention is also the inventor of U.S. Pat. No. 8,742,239 ("patent '239"). The present invention is a refinement and improvement to patent '239. For the sake of clarity, the background of patent '239 is repeated here, with appropriate corrections and additions.

Musicians who play stringed instruments, in particular guitars, use picks, also called plectrums. A pick is a small piece of thin plastic, metal, stone, bone, or other thin, rigid material, used to strum the strings of an instrument. Picks are usually, roughly speaking, triangular or teardrop in shape. The material, thickness, geometry, and tip of the pick affect the sonic characteristics of the instrument. For example, a really stiff, thick pick will have a very different sound from a thin, softer pick. The angle, depth, and direction of motion of the pick striking the strings is called the attack. The attack is individualized for each musician. Some musicians have quite an aggressive attack, striking the strings with a substantial portion of the pick, while using a locked thumb, putting quite a bit of force on the pick.

During extended playing, such as concerts, recording sessions or practices, stringed instrument musicians often find a need to use a new pick, for a variety of reasons. After playing for a while, a musician's hands may become sweaty or moist, making it more likely that the musician will drop or mishandle the pick. While rapidly strumming, many musicians lose their grip on their pick, and drop the pick. Additionally, due to the thin, brittle nature of picks, they tend to break during prolonged play, especially when used with an aggressive attack. Lastly, with extended play, the point of the pick can be rubbed away due to string friction. As the pick loses its point, it changes sonic characteristic and the attack on the string. Relatively speaking, thin and medium thickness picks tend to crack or break more than thicker ones.

Ideally, when a musician needs a new pick during a session, a pick should be available to the strumming hand of the musician, with no time lag. If the musician must stop to grab a pick, it can affect the quality of the concert or recording. Additionally, it can disrupt the group with whom the musician is practicing. An ideal pick holder would allow the musician to get a new pick with a quick, reliable movement, without interrupting playing. The solution should allow the musician to get a new pick a number of times. In other words, the pick holder should have capacity for a plurality of picks, and it should offer a way of rapidly grasping a single new pick.

Currently, when a musician needs a new pick during a session, they have a limited number of options. First, they can stop playing and get a new pick. Second, they can use their nails, instead of the pick. Third, they can use a deformed or partially broken pick, until they have a reasonable chance to replace the pick. Fourth, they can use one of the existing solutions for a pick holder. Fifth, they can use the invention described in patent '239.

PRIOR ART REVIEW

None of the current solutions in the prior art are ideal. Some musicians use small, clear plastic bags to hold picks. The musician will keep this bag nearby while playing. The problem with this solution is that the musician has to stop playing, pick up the bag, remove a pick, and resume playing.

Some musicians use pick-holder products that are designed to fit on the neck or headstock of the instrument near the tuning, such as the Wedgie Headstock Pick Holder. There are a substantial number of patents for pick holders mounted on or near the headstock, including the following: U.S. Pat. No. 1,784,934, by named inventor Johansson, entitled, "Plectrum holder" ("Johansson '934"); U.S. Pat. No. 5,127,300, by named inventor Silverman, entitled, "Pick holder for stringed musical instrument" ("Silverman '300"); and U.S. Pat. No. 6,639,136, by named inventor Judd, entitled, "Guitar pick holder" ("Judd '136"). The problem Johansson '934, Silverman '300, and Judd '136 is that, since the picks are stored on the headstock, the picks are presented, or made available, to the wrong hand of the musician. In order to access a new pick, the musician still needs to cease strumming the instrument, reach to the headstock with his or her strumming hand, and then resume playing.

Some musicians use pick holders that offers access to a spring-loaded stack of picks. The prior art contains many patents disclosing various types of spring loaded pick holders, including the following: U.S. Pat. No. 5,847,299, by named inventors Zovko, et. al., entitled, "Self-contained pick dispenser" ("Zovko '299"); U.S. Pat. No. 7,626,103, by named inventor Phillips, entitled, "Musical instrument pick holder" ("Phillips '103"); and U.S. Pat. No. 7,629,522, by named inventor Isaacson, entitled, "Stringed pick pincher" ("Isaacson '522"). Zovko '299, Phillips '103, and Isaacson '522 are sub-optimum for the same of reasons. First, the pick holder will respond to picks differently, based on the surface texture, thickness, and material of the pick. Many musicians have a wide variety of picks, with the picks coming in variety of hardnesses, thicknesses, and surface finishes. Spring loaded pick holders jam-up when loaded with textured picks. Additionally, thicker picks tend to be difficult to remove from spring loaded pick holders. Lastly, due to the varying thicknesses of picks, the spring loaded holders that stack the picks, such as Zovko '299, tend to dispense more than one pick when filled with thinner picks.

Some musicians use pick holders that retain the picks using some form of friction fit. The prior art contains many patents disclosing various types of pick holders that use friction fits to retain the pick, including the following: U.S. Pat. No. 5,299,485, by named inventor Denton, entitled, "Stringed instrument pick and slide holder" ("Denton '485"); U.S. Pat. No. 5,651,468, by named inventor Irizarry, entitled, "Holder for thin planar objects" ("Irizarry '468"); and U.S. Pat. No. 6,215,052, by named inventors Giddens, et. al., entitled, "Guitar pick holder" ("Giddens '052"). Denton '485, Irizarry '468, and Giddens '052 share a common cluster of problems. First, due to the retention force of the invention, the musician has to use two fingers to remove the pick. This means the musician's strumming hand must stop. Additionally, retention force varies greatly with the style, finish, and thickness of the pick. These types of pick holders make the musician prone to mishandling the pick, when attempting to remove one quickly.

Some musicians use pick holders that retain picks in a pocket, or pockets, sized to hold guitar picks. The prior art contains many patents disclosing various types of pick holders, pick slots, or both, including the following: U.S. Pat. No. 4,785,708, by named inventor (Stevie Ray) Vaughan, entitled, "Pick holder for stringed instruments" ("Vaughan 708"); U.S. Pat. No. 5,905,217, by named inventor Byers, entitled, "Pick holder" ("Byers '217"); U.S. Pat. No. 6,472,590, by named inventor Kulik, entitled, "Arm sheath for use with a stringed instrument" ("Kulik '590"); and U.S. Pat. No. 8,097,799, by named inventor Tran, entitled, "Plectrum receptacle systems" ("Tran '799"). Just a raw pocket, roughly sized to fit a guitar pick, makes a poor pick holder. The pocket will fit some picks snuggly and other picks loosely. Some of the prior art tried to overcome this problems, such as Stephen Ray Vaughan's U.S. Pat. No. 4,758,708. This patent uses slots within each pocket to create proper retention force. The problem with Vaughan '708 is that it requires two fingers to remove a pick, precisely because it provides positive retention force. The Tran '799 also uses a retainer to forcibly hold the pick. Kulik '590 is for a pick holder sewn into a flexible arm sleeve. The flexible arm sleeve creates a force fit of the pick, while the flexible sleeve is being worn. In essence, these three patents are using a force fit in a pocket, which creates a variable retention force, and a retention force that requires, at a minimum, a finger and a thumb, to remove a new pick. Other pocket-based solutions, such as Byers '217, offer just a single pick in a pocket or sleeve.

U.S. Pat. No. 7,417,184, by named inventor Weathersby, entitled, "Portable guitar pick holder apparatus" ("Weathersby '184"), discloses a hybrid between a spring-loaded pick-holder and a pick-holder sleeve. Weathersby '184 teaches a spring-loaded pick-holder that has a strap, to wear on the arm while playing a guitar. Weathersby '184 has a plurality of openings, shaped so that a guitar pick can be partially revealed and partially concealed. Internal springs exerts a force on a stack of guitar picks. A portion of the outer-most guitar pick extends out of the pick-holder so that it can either be drawn out by the user, or it can be dispensed by use of a switch. Weathersby '184 has problems common with many other pick holders and pick dispensers. In one embodiment, it would take two hands to dispense a pick: one hand would work the selection switch and the other hand would gather the pick. In the other embodiment, Weathersby '184 has the same problems as other spring-loaded pick-holders. First, the pick holder will respond to picks differently, based on the surface texture, thickness, and material of the pick. Many musicians have a wide variety of picks, with the picks coming in variety of hardnesses, thicknesses, and surface finishes. Spring loaded pick holders jam-up when loaded with textured picks. Additionally, thicker picks tend to be difficult to remove from spring loaded pick holders. Lastly, due to the varying thicknesses of picks, the spring loaded holders that stack the picks, such as Weathersby '184, tend to dispense more than one pick when filled with thinner picks.

Clearly, none of the prior art offers an ideal solution for a pick holder for a stringed instrument. The inventor's own prior patent, U.S. Pat. No. 8,742,239, by named inventor Storck, entitled, "Easy access flexible container and pick holder for stringed musical instrument picks," ("Storck '239") cures most of the prior art problems. After repeated use, the pick-holding slots of Storck '239 begin to stretch, allowing picks to unintentionally come loose. The present invention attempts to overcome this problem.

SUMMARY OF THE INVENTION

The present invention is a pick holder for musical instrument picks, that attaches to the musical instrument or a strap holding the musical instrument. The present invention may take on a variety of shapes, for aesthetic purposes, such as cubic, rectangular, cylindrical, triangular, pyramidal, polygonal, or a combination. Profiles can range from thick to thin.

Regardless of the shape of the flexible container and pick holder, the invention has a plurality of surfaces with a front side oriented towards the strumming hand of the musician. The front side is made of a flexible material. In one embodiment, the front face presents a plurality of picks to the strumming hand of the musician, with the picks being held in place, on the face of the pick-holder, with retention clips. The retention clip, itself, is adhered to the front, flexible surface.

The retention clip is fabricated from a single piece of material. The retention clip has an inner surface and an outer surface. The portion of the outer surface of the retention clip that is attached to the front, flexible surface is substantially flat. The retention clip curves around, upon itself. The inner surface of the retention clip comes in proximity with itself, creating a clamping area.

In a second embodiment, a soft pad, made of felt, cloth, plastic, or stitching, may be added to act as a stop on the retention clip. When the pick is placed in the retention clip, the soft pad causes the free end of the pick to be elevated. The pick is easily removed by pressing the free end of the pick to the front surface, and then sliding the pick. Guitar pick thickness or texture is immaterial; the pick slides easily. The pick holder has an inner portion to hold additional guitar picks, which are not immediately presented for use.

In a third embodiment, the front face presents a plurality of picks to the strumming hand of the musician, with the picks being held in place, on the face of the pick-holder, with retention clips. The flexible front surface, itself, acts as a stop for the retention clip, with part of the retention clip being on one side of the front, flexible surface, and part of the retention clip being on the other side of the front, flexible surface. The pick is easily removed by pressing the free end of the pick to the front flexible surface, and then sliding the pick. The front flexible surface is both slick, and compressible, allowing the pick to be easily removed from the retention clip. Guitar pick thickness or texture is immaterial; the pick slides easily.

The material of the face of the flexible container and pick holder is, obviously, flexible, and allows the pick to slide on it. Suitable materials include, but are not limited to, leather, imitation leather, polyethylene, polypropylene, cotton, nylon, polyester, polyether, burlap, canvas, wool, satin, and silk. The musician can easily remove a pick from the container by sliding it out with the thumb of his or her strumming hand. The present invention comes with means for securing it to the strap, peg, or body of the instrument, including, but not limited to a plastic or metal clip, hook-and-loop fasteners, strings, and elastic loops. The present invention is sized such that it is unobtrusive, when secured to the musical instrument, strap, belt, or peg of the instrument.

BRIEF DESCRIPTION OF THE DRAWINGS

There are twenty-one relevant drawings.

DETAILED DESCRIPTION OF THE PREFERRED EMBODIMENTS

Figure 1:
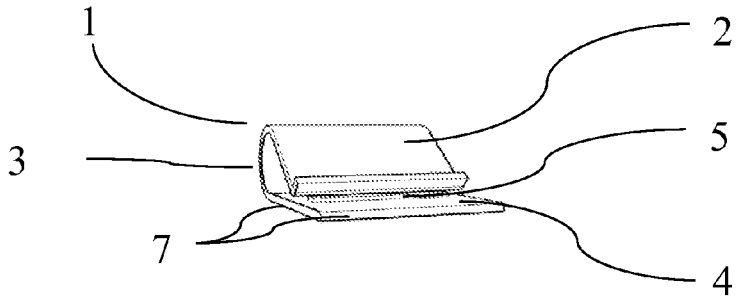
FIG. 1 is a perspective view of a retention clip.
Figure 2:
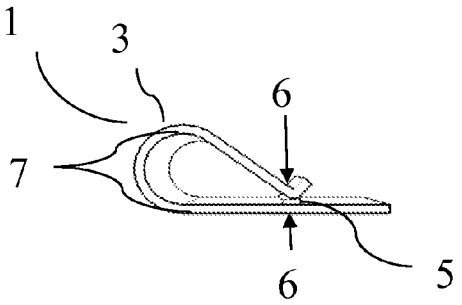
FIG. 2 is a lateral view of a retention clip.
Figure 3A:
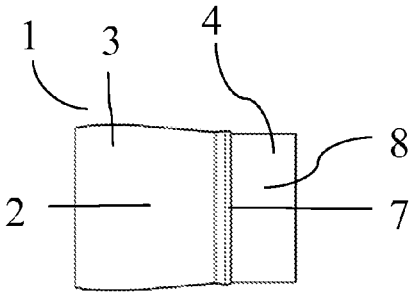
FIG. 3A is a top view of a retention clip.
Figure 3B:
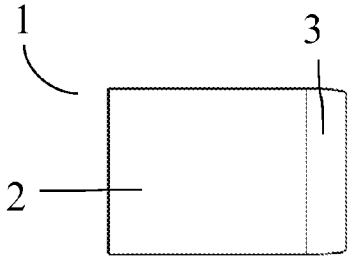
FIG. 3B is a bottom view of a retention clip.
Figure 4:
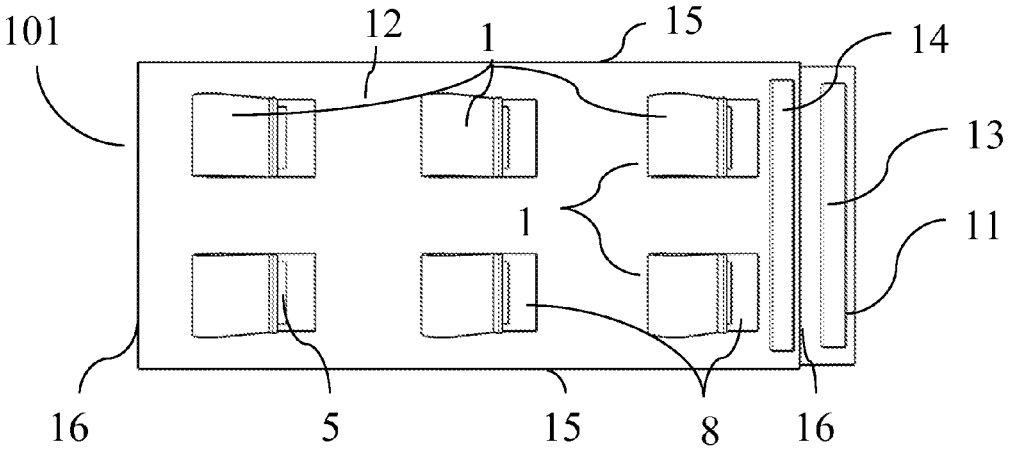
FIG. 4 is a full front view of a pick holder.
Figure 5:
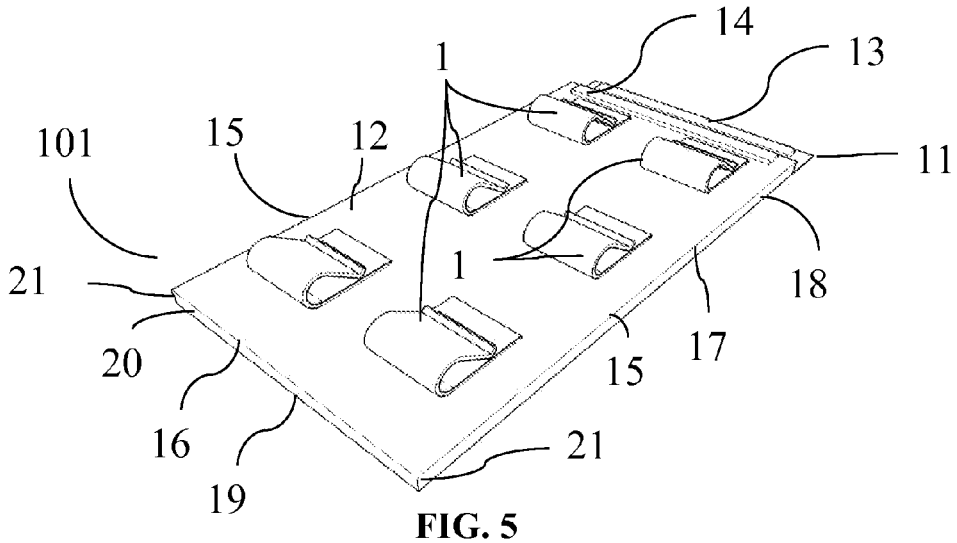
FIG. 5 is a iso view of a pick holder.
Figure 6:
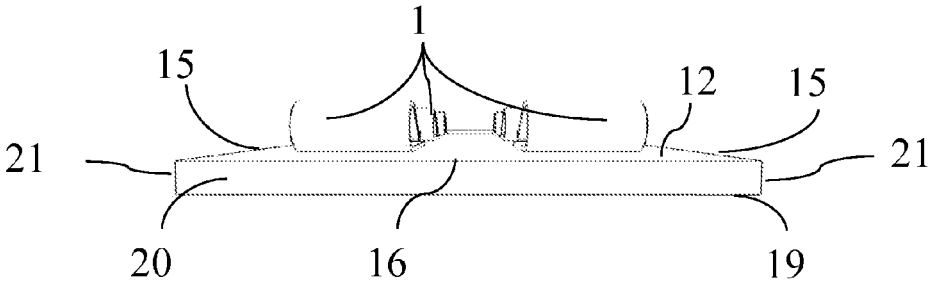
FIG. 6 is an end view of a pick holder.
Figure 7:
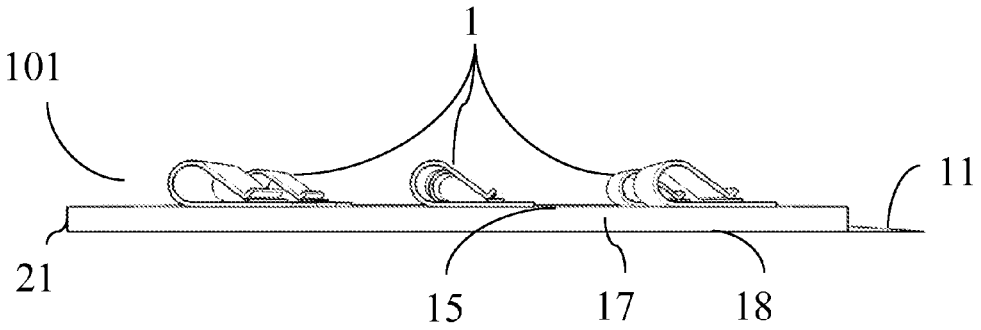
FIG. 7 is a full lateral view of a pick holder.
Figure 8:
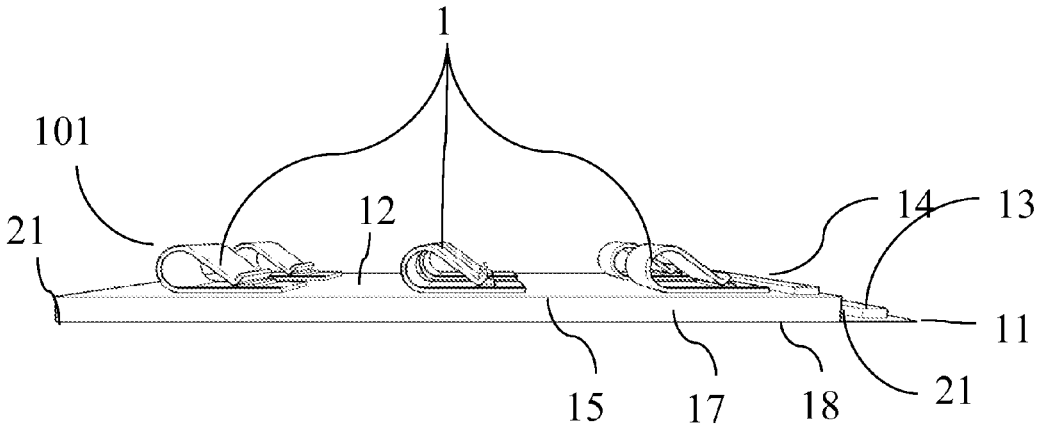
FIG. 8 is an elevated lateral view of a pick holder.
Figure 9:
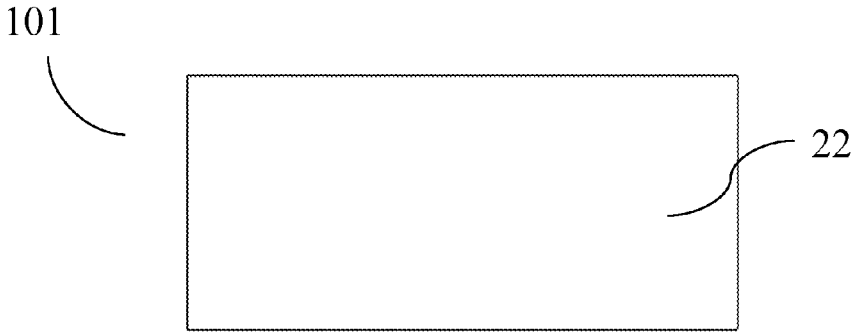
FIG. 9 is a back view of a pick holder.

The following description represents the inventors' current preferred embodiments. The description is not meant to limit the invention, but rather to illustrate its general principles of operation. Examples are illustrated with the accompanying drawings. A variety of drawings are offered, showing the present invention with configurations for attaching retention clips to a pick holder.

FIG. 1, FIG. 2, FIG. 3A and FIG. 3B show the retention clip 1. The retention clip 1 is constructed from a single piece of material, having an outer surface 2, an inner surface 4, a curved portion 3, and an edge 7. This embodiment of the retention clip 1 has a compressible pad 5, although a retention clip 1 can be constructed without a compressible pad 5. The retention clip 1 is formed so that it has a clamping region 6. This is done by curving the inner surface 4 back upon itself, making a curved portion 3. There is a flat portion 8 of the inner surface 4 and outer surface 2. The retention clip can be made out of a variety of useful materials, including, but not limited to, polypropylene, ABS, HDPE, LDPE, copper, or spring steel FIGS. 4-9 show a first embodiment of a pick holder 101. The pick holder 101 has a volume defined by a front surface 12, two side surfaces 17, a bottom surface 20, and a back surface 22. The pick holder 101 has a flap 11, or other means of closing the top of the pick holder 101. The flap 11 has a one-half of a hook-and-loop fastener 13, with the other half of the hook-and-loop fastener 14 adhered to the front surface 12. On the front surface 12, a plurality of retention clips 1 are adhered. The flat portion 8 of the retentions clips 1 can be adhered to the front surface 12 using a variety of adhesive methods, including gluing and pressure sensitive adhesive.

The pick holder 101 has two equal length long edges 15, joining the front surfaces 12 to the side surfaces 17. The pick holder 101 has two equal length long edges 18 joining the side surfaces 17 to the back surface 22. The pick holder 101 has a short edge 16 joining the front surface 15 to the bottom surface 20. The pick holder 101 has a short edge 19 joining the bottom surface 20 to the back surface 22. The pick holder has two edges 21 joining the side surfaces 17 to the bottom surface 20.

Figure 10:
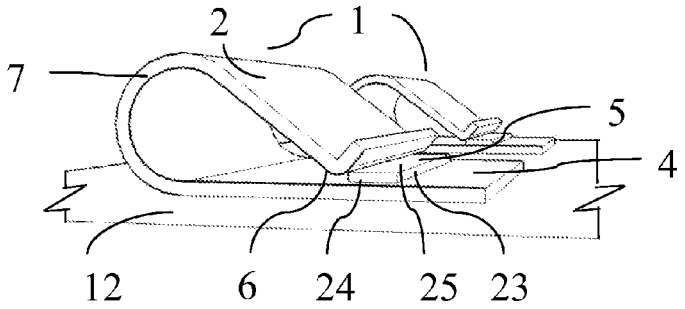
FIG. 10 is a close-up isolation of a retention clip on a pick holder.

FIG. 10 shows a close-up of the first embodiment of the pick holder 101, highlighting the retention clips 1. The retention clip 1 is constructed from a single piece of material, having an outer surface 2, an inner surface 4, and an edge 7. This embodiment of the retention clip 1 has a compressible pad 5. The compressible pad 5 has a top surface 25, a bottom surface (not visible), two equal length side surfaces 24 (only one shown), and two equal length front surfaces 23 (only one shown). The compressible pad 5 is placed in proximity of the clamping region 6 so that it acts as a stop for the retention clip 101.

Figure 11:
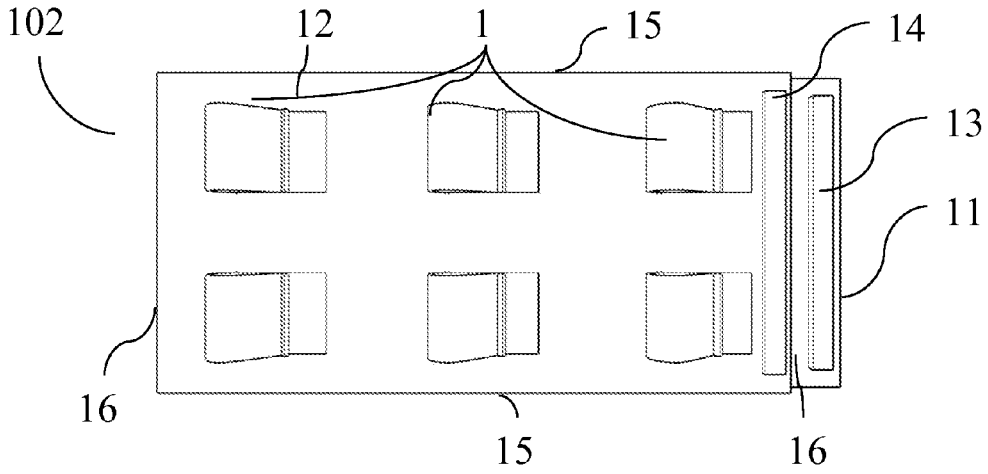
FIG. 11 is a full front view of a second embodiment of a pick holder.
Figure 12:
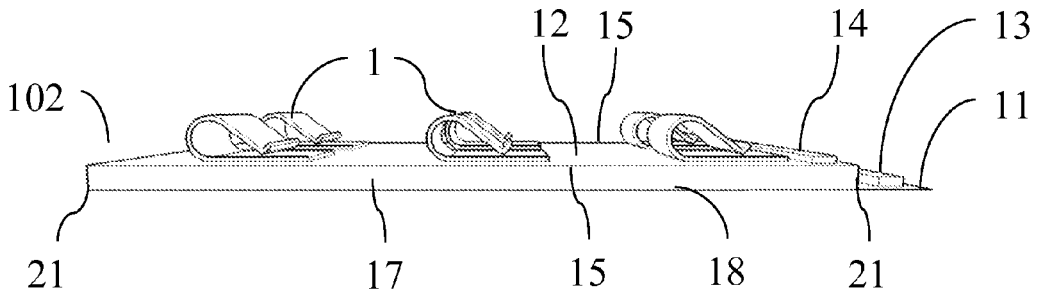
FIG. 12 is an elevated lateral view of a second embodiment of a pick holder.

FIGS. 11-12 show a second embodiment of the pick holder 102, which is the same as the first embodiment of the pick holder 101, except that it 102 has not compressible pad 5. A plurality of retention clips 1 are adhered to the front surface 12. The front surface 12 has two equal length long edges 15 and two equal length short edges 16. The pick holder 102 has a flap 11, that can be closed with a hook-and-loop fastener 13, 14.

Figure 13:
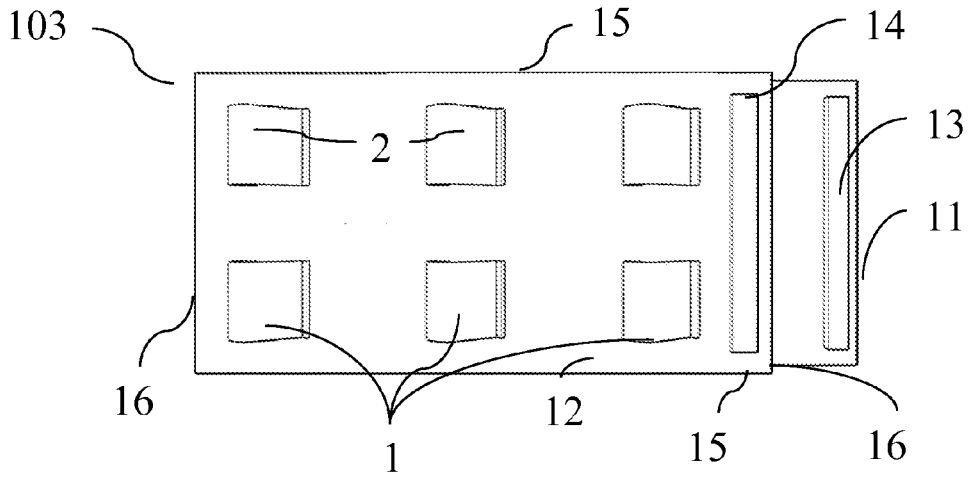
FIG. 13 is a full front view of a third embodiment of a pick holder.
Figure 14:
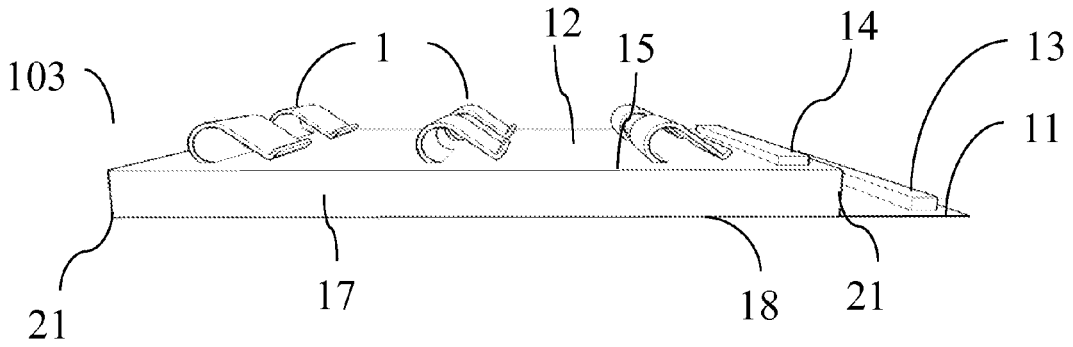
FIG. 14 is an elevated side view of a third embodiment of a pick holder.
Figure 15:
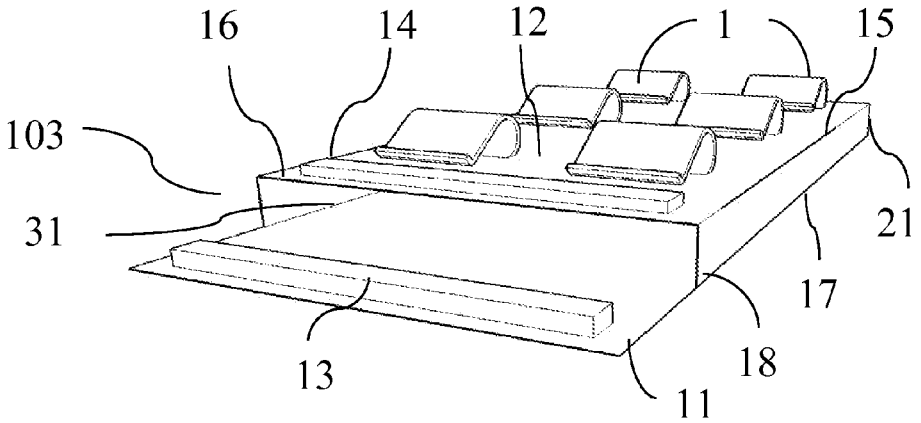
FIG. 15 is an isolation top view of a third embodiment of a pick holder.

FIGS. 13-15 show a third embodiment of the pick holder 103. This pick holder 103 has retention clips 1 embedded in the front surface 12. The retention clips 1 are durably adhered to the inner surface of the front surface 12. This embodiment 103 has a front surface 12, side surfaces 17, long edges 15, 18, and short edges 16, similar in placement, function, and length to the first two embodiments 101, 102. This embodiment 103 has a flap 11, which can be closed with a two-part hook-and-loop fastener 13, 14.

FIG. 15 shows the interior volume 31 of the pick holder 103. The interior volume 31 is defined by the front surface 15, back surface 22, side surfaces 17, and bottom surface 20. The interior volume 31 can be enclosed when the flap 11 is closed using the two-part hook-and-loop fastener 13, 14.

Figure 16:
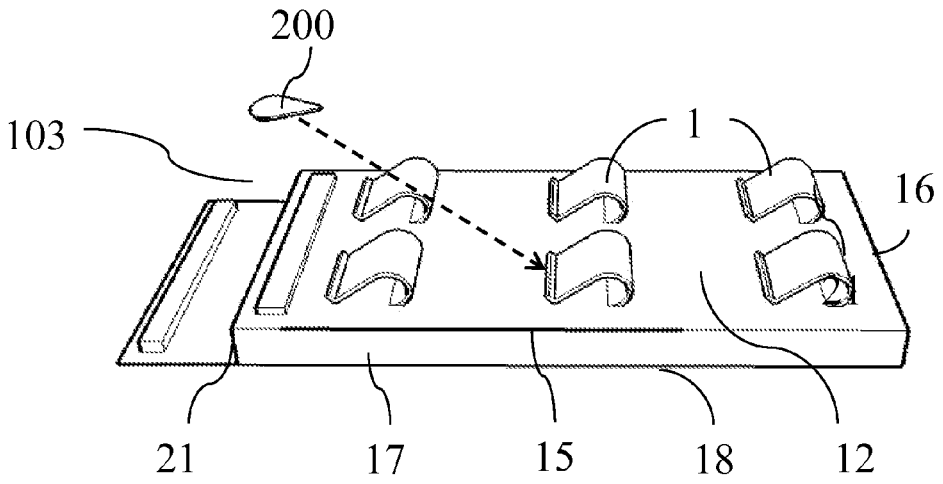
FIG. 16 is an elevated side view of a third embodiment of a pick holders, with a guitar pick.
Figure 17:
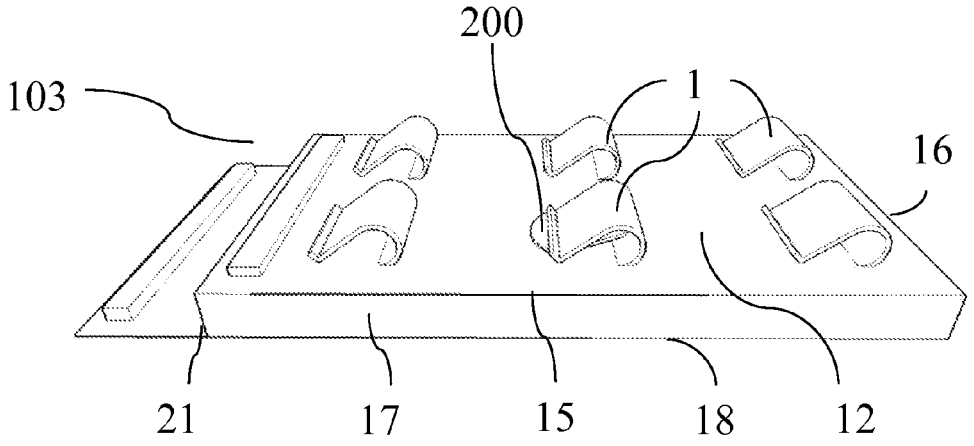
FIG. 17 is an elevated side view of a third embodiment of a pick holder, with a guitar pick in situ.

FIGS. 16-17 show the use of the third embodiment 103 with a guitar pick 200. In FIG. 16, the guitar pick 200 is shown, with a dashed arrow showing where it will be placed. FIG. 17 shows the guitar pick 200, in situ, in a retention clip 1

Figure 18:
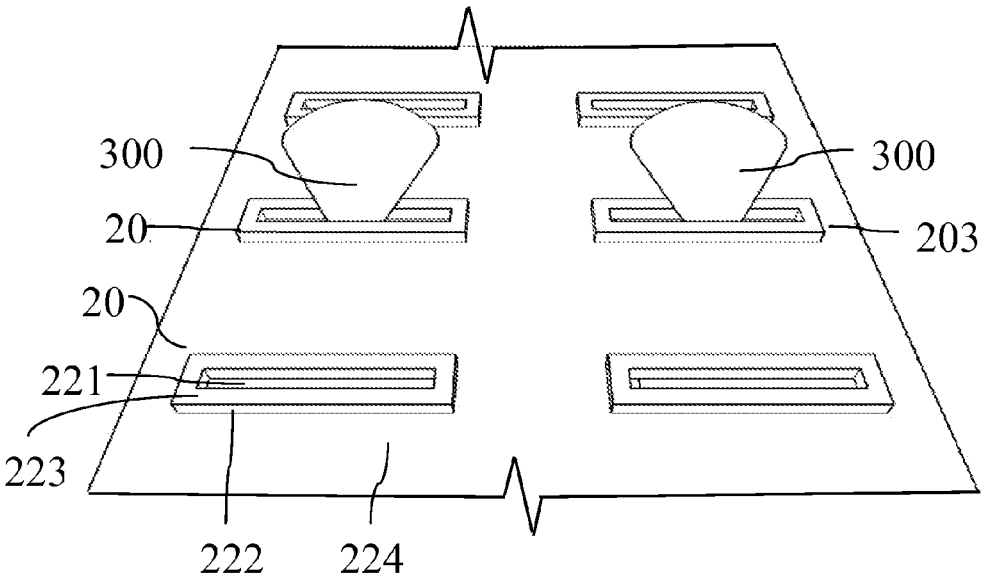
FIG. 18 is a close-up isolation of a prior invention, for comparison.

FIG. 18 shows a front surface of a previous pick holder invention, for comparison. The front surface 224 contains a plurality of slots 20. The slots 20 are sized to accommodate guitar picks 300. The slots have a raised rim 203 around the periphery of the opening 221. The raised rim 203 could be made from plastic or stitching. The raised rim 203 has an upper surface 223 and a side surface 222. The problem with the slots 20 is that, over time, guitar picks 300 tend to stretch them, reducing their retention force. Ultimately, guitar picks 300 may fall out after repeated usage. The present invention corrects this problem through the use of retention clips 1.

Figure 19:
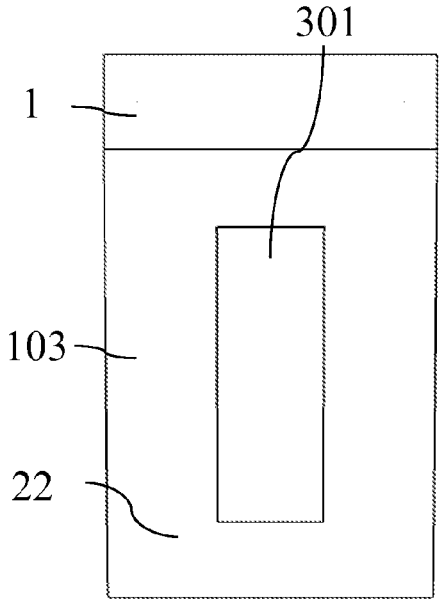
FIG. 19 is a back view of a pick holder, showing one-half of a hook-and-loop fastener.
Figure 20:
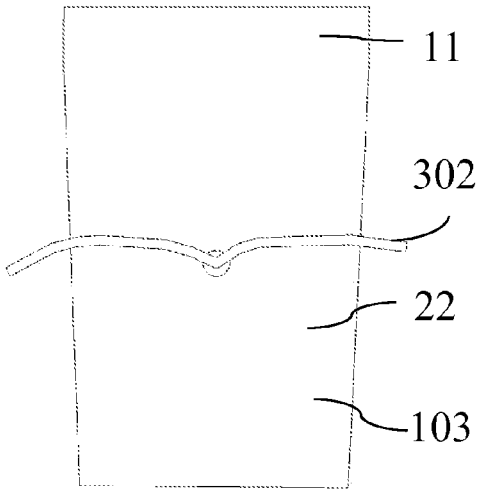
FIG. 20 is a back view of a pick holder, showing a tie fastener.
Figure 21:
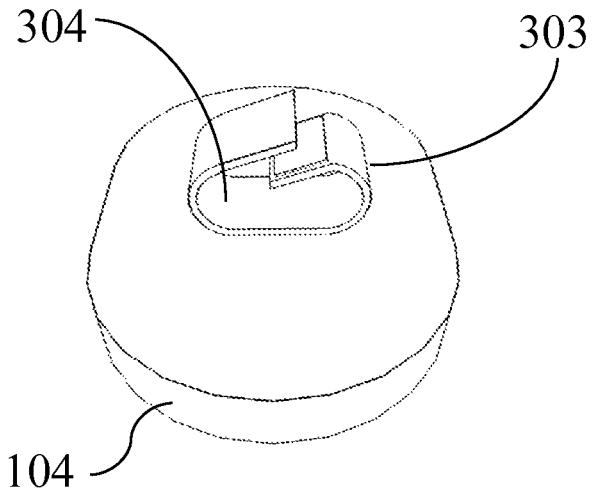
FIG. 21 is a back view of a pick holder, showing an elastic strap with Velcro fastener.

FIGS. 19-21 show a variety of means for connecting the present invention to the neck of a guitar, a strap, or a belt. In FIG. 19, shows the third embodiment 103 with one-half of a hook-and-loop connector 301 connected to the back. FIG. 20 shows the third embodiment 103 with a tie fastener 302, for tying onto a guitar neck, attached to the back 22. FIG. 21 shows an embodiment 104 with an elastic strap 303 connector. The two ends of the elastic strap 303 can be attached to one another through the use of a hook-and-loop connector 304.

I claim:

1. A pick holder, with a defined interior created by a plurality of planar or curved segments made from a slick, flexible material, containing at least a first face that can be disposed and oriented near a musician's strumming hand, such that a thumb of said musician's strumming hand can touch said face without reaching or extending said musician's arm; said face containing a plurality of retention clips, durably attached to the face, sized to hold and retain a guitar pick; wherein the retention clip is formed from a single piece of material, so that the retention clip has an inner surface and outer surface; wherein the portion of the retention clip that is durably attached to the surface is substantially flat; and wherein the inner surface curves back around on itself, creating a clamping area.

2. The pick holder of claim 1, wherein the retention clip is fabricated from polypropylene, HDPE, LDPE, ABS, copper, or spring steel.

3. The pick holder of claim 1, wherein a compressible pad is positioned in the clamping area of the inner surface, durably attached to the flat portion of the inner surface.

4. The pick holder of claim 1, further comprising a means of attaching the pick holder to a guitar, guitar strap, or belt.

5. The pick holder of claim 4, wherein the attaching means is a two-piece hook-and-loop fastener.

6. The pick holder of claim 4, wherein the attaching means is a pair of ropes or straps that can be tied to secure the pick holder.

7. The pick holder of claim 4, wherein the attaching means is a two piece elastic strap, that can be joined by a two-piece hook-and-loop fastener.

8. A pick holder, with a defined interior created by a plurality of planar or curved segments made from a slick, flexible material, containing at least a first face that can be disposed and oriented near a musician's strumming hand, such that a thumb of said musician's strumming hand can touch said face without reaching or extending said musician's arm; said face containing a plurality of retention clips, and sized to hold and retain a guitar pick; wherein the retention clip is formed from a single piece of material, so that the retention clip has an inner surface and outer surface; wherein the retention clip has a substantially flat portion and a curved portion; and wherein the inner surface curves back around on itself, creating a clamping area.

9. The pick holder of claim 8, wherein the retention clip is fabricated from polypropylene, HDPE, LDPE, ABS, copper, or spring steel.

10. The pick holder of claim 8, wherein the flat portion of the retaining clip is interior to the first face.

11. The pick holder of claim 9, wherein the flat portion of the retaining clip is durably adhered to the interior of the first face.

12. The pick holder of claim 8, further comprising a means of attaching the pick holder to a guitar, guitar strap, or belt.

13. The pick holder of claim 12, wherein the attaching means is a two-piece hook-and-loop fastener.

14. The pick holder of claim 12, wherein the attaching means is a pair of ropes or straps that can be tied to secure the pick holder.

15. The pick holder of claim 12, wherein the attaching means is a two piece elastic strap, that can be joined by a two-piece hook-and-loop fastener.

* * * * *